United States Patent [19]

Gustafsson et al.

[11] Patent Number: 4,840,340

[45] Date of Patent: Jun. 20, 1989

[54] TELESCOPIC BRACE ASSEMBLY

[75] Inventors: Hans Gustafsson, Västerås; Thomas Hallberg, Köping, both of Sweden

[73] Assignee: GH Trading AB, Västerås, Sweden

[21] Appl. No.: 176,509

[22] Filed: Apr. 1, 1988

[51] Int. Cl.[4] ..... A47B 1/04

[52] U.S. Cl. ..... 248/240.4; 108/82

[58] Field of Search ..... 248/240, 240.3, 240.4, 248/242, 351, 161, 613; 108/77, 80–82; 292/262, 278, 338

[56] References Cited

U.S. PATENT DOCUMENTS

| | | | |
|---|---|---|---|
| 1,228,042 | 5/1917 | O'Dowd . | |
| 1,350,056 | 8/1920 | Barry | 248/613 |
| 2,154,125 | 4/1939 | Dillon . | |
| 2,284,003 | 5/1942 | Luppert . | |
| 2,352,837 | 7/1944 | Hillenbrand . | |
| 2,373,125 | 4/1945 | Loepsinger | 248/613 |
| 2,835,522 | 5/1958 | Serto . | |
| 4,068,601 | 1/1978 | Marsh . | |

FOREIGN PATENT DOCUMENTS

| | | | |
|---|---|---|---|
| 2717856 | 11/1978 | Fed. Rep. of Germany | 108/80 |
| 196398 | 5/1965 | Sweden . | |
| 1524281 | 9/1978 | United Kingdom . | |

*Primary Examiner*—J. Franklin Foss
*Assistant Examiner*—Robert A. Olson
*Attorney, Agent, or Firm*—Sughrue, Mion, Zinn, Macpeak and Seas

[57] ABSTRACT

A telescopic brace assembly for supporting a work surface 1 which can be folded relative to a frame structure 5 includes two tubes 6,7 which are capable of being moved telescopically, one within the other, and the mutually opposite free ends of which are intended to be pivotally connected to a respective one of the objects. Arranged within the telescopic tubes is a spring 14 which biases the tubes together. The brace assembly further includes a locking arm 8 for releasably locking the tubes in a working position. The spring is arranged to be compressed as the tubes are extended one from the other, while storing energy. The extent to which the tubes can be withdrawn one from the other is determined by the extent to which the spring can be compressed.

7 Claims, 4 Drawing Sheets

TELESCOPIC BRACE ASSEMBLY

BACKGROUND OF THE INVENTION

The present invention relates to a telescopic stay or brace assembly for supporting two objects which are capable of being folded relative to one another, and particularly, although not exclusively, for supporting a work surface which can be folded relative to a frame structure.

In the case of foldable work surfaces which are supported in their raised positions by means of some suitable form of brace assembly, it is desirable that the brace can be manipulated easily, both when locking the brace subsequent to raising the work surface and when releasing the brace in order to lower the work surface. The brace must also be capable of locking the raised work surface reliably and to form a firm support for the work surface in the desired working position thereof.

A telescopic brace or stay which fulfills these desiderata to a large extent is known from the British Patent Specification No. 1 524 281 and comprises two tubes which can be displaced telescopically in relation to one another and the mutually opposite ends of which are each pivotally connected to a respective one of said two objects, and further comprises an inner guide tube arranged within the telescopic tubes, a tension spring which extends axially through all tubes, and locking means for releasably locking the telescopic tubes in a given working position relative to one another.

This known brace, however, is encumbered, inter alia, with the following drawbacks. When the telescopic tubes are retracted one within the other, the inner guide tube projects beyond the ends of the telescopic tubes, therewith preventing the brace from being fitted directly to a complete surface, e.g. a wall. Instead it is necessary to fit the brace to a surface which is laterally offset, so that the inner guide tube can be permitted to project out from the telescopic tube. Alternatively, it may be necessary to form a hole in a rearwardly lying wall in order to accommodate the guide tube.

When braces of this particular kind are intended, inter alia, to support tables or work surfaces in trains, watercraft, caravans and in other cases where relative movement of the aforesaid two objects can occur, it is essential that the brace assembly is capable of preventing the work surface from swinging, or of damping such swinging movement, when the work surface is in its lowered position. Since, when the known brace assembly is retracted the aforesaid inner guide tube projects from the outer telescopic tube, the tension spring has no damping effect whatsoever on the swinging movement of the downwardly folded work surface.

Our earlier U.S. patent application No. 104,022 describes and illustrates a brace assembly of the aforesaid kind which, inter alia, eliminates these drawbacks. A characteristic feature of this improved brace assembly is that the inner guide tube is fixed axially in relation to one of the telescopically movable tubes and accompanies the movement of this one tube in relation to the other telescopic tube. A further characteristic feature is that each end of the tension spring is fixed relative to a respective telescopic tube and that the length of the spring is such that the spring will constantly exert on the tubes a force which strives to retract the tubes one inside the other.

The inner guide tube of this improved brace assembly will not protrude from the telescopic tubes, and positive damping of any relative movement between the objects to which the brace is fitted is effected by means of the spring, even when the tubes are retracted and the work surface is folded down.

A common drawback with both of these earlier known brace assemblies however, is that the telescopic tubes can be drawn out completely from one another. In the case of the aforesaid known brace assemblies in which the tubes fit closely one within the other and in which the tension spring extends axially through the tubes, it is difficult, without further complicating the construction and increasing its costs, to provide a stop which will prevent one tube from being withdrawn completely from the other.

SUMMARY OF THE INVENTION

Consequently, the prime object of the present invention is to provide a telescopic brace assembly of the aforementioned general kind in which, inter alia, the problem of preventing the complete separation of the telescopic tubes is overcome.

This object is achieved in accordance with the present invention by replacing the tension spring used in the known brace assembly with a compression spring which is so arranged that when extending the telescopic tubes, one from the other, the spring is compressed while storing energy therein, the extent to which the telescopic tubes can be extended being determined by the extent to which the spring can be compressed.

According to one preferred embodiment, one end of the compression spring co-acts with a stop means which is fixed in relation to one of the telescopic tubes and the spring is intended to be compressed against the stop means with the aid of a pull rod or like device which moves together with the other of said tubes and which is connected to the other end of the spring.

The auxiliary reinforcing or strengthening tube employed in the earlier known brace assemblies can be dispensed with in the inventive brace assembly and the compression spring can therewith be placed internally of the two telescopic tubes, such that the spring is compressed against a stop means located at its free end, with the aid of a pull rod which extends through the spring and one end of which is located in and fixed relative to the outer telescopic tube and the other end of which is connected to the end of the spring distal from the stop means.

If desired, however, the inventive brace assembly may incorporate an auxiliary reinforcing tube which is placed in the outer telescopic tube and fixed in relation thereto and which slides in said inner telescopic tube when extending and collapsing the brace assembly. In this case the compression spring is mounted in the reinforcing tube so that the spring is compressed against a stop means located at the free end of said tube with the aid of a pull rod which extends through the stop means and one end of which is located in and fixed in relation to the inner telescopic tube and the other end of which is connected to the end of the spring distal from the stop means.

The stop means preferably comprises a first stop plate which is firmly held in one end of an associated tube and the aforesaid other end of the pull rod is connected to a second stop plate which is movable in said tube and which co-acts with the inwardly located end of the spring.

These stop plates and the spring located therebetween will co-act with one another to limit the extent to which the telescopic tubes can be withdrawn from each other.

The stop plates preferably have an axial extension which enables the plates to reinforce the surrounding tube in the region of said plates.

DETAILED DESCRIPTION OF THE PREFERRED EMBODIMENTS

Figure 1A:
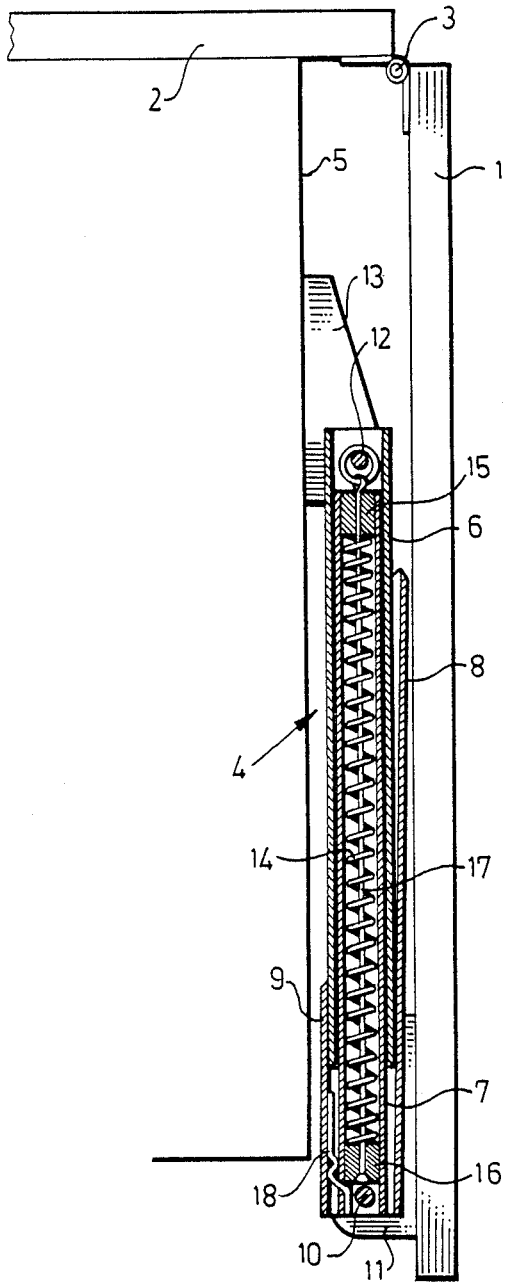
FIG. 1A is a sectional view of a brace assembly according to the present invention and illustrates the brace in a state of rest.

In FIG. 1A the reference numeral 1 identifies a work surface which is hinged to a stationary or fixed surface 2 by means of a hinge 3. In order to hold the work surface 1 in a horizontal work position flush with the fixed surface 2, a brace assembly 4 according to the invention is mounted between the work surface 1 and a supportive frame structure 5, which may consist, for example, of a table frame, a wall or some corresponding structure.

Figure 1B:
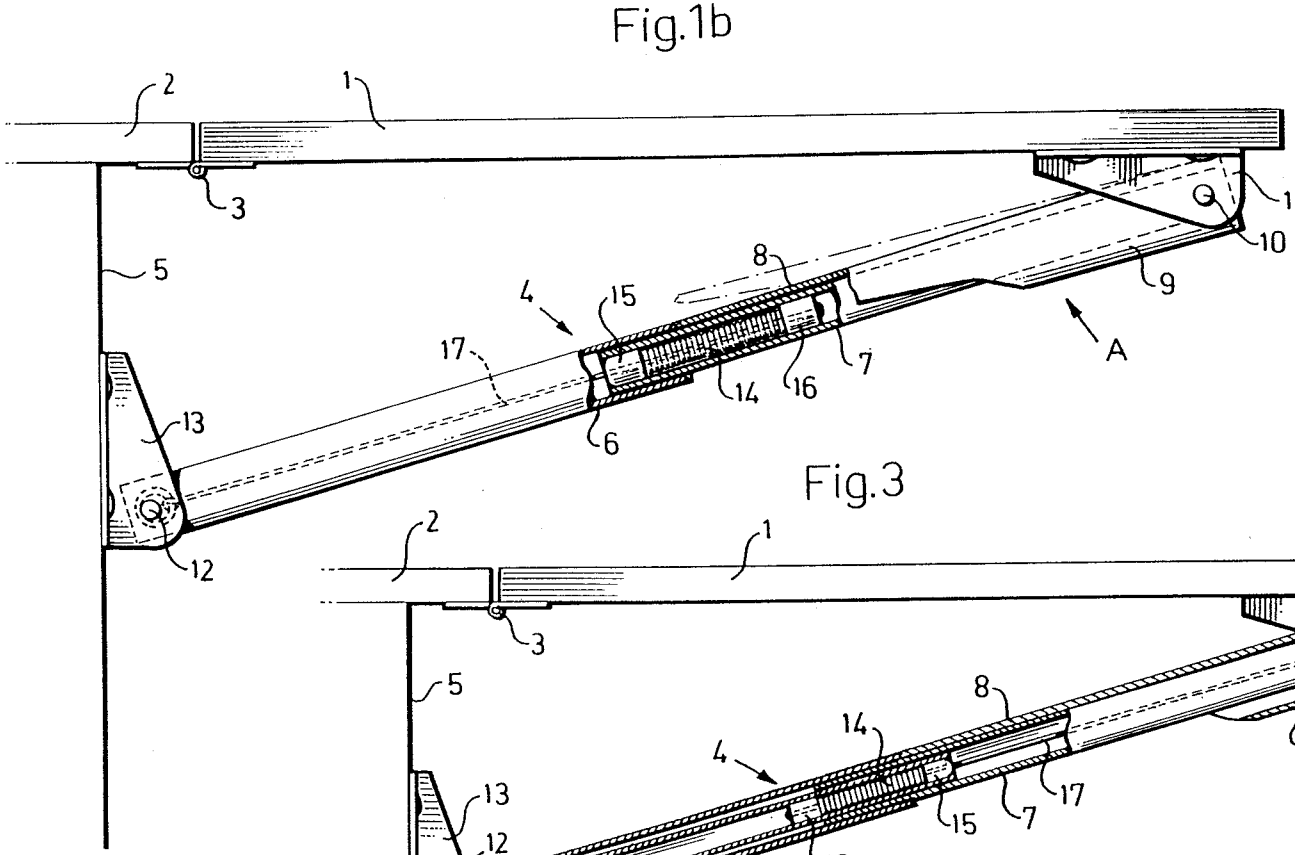
FIG. 1B illustrates the brace assembly of FIG. 1 with the brace in an active working position.

The brace assembly 4 includes an outer telescopic tube 6 and an inner telescopic tube 7, which are arranged to slide telescopically one within the other. Reference numeral 8 identifies a locking arm, one end 9 of which 9 of which is sleeve-shaped and embraces the inner tube 7, and the other end of which is cupped or half-cylindrical in shape and presents a bevelled end surface which in its rest position abuts the outer surface of the outer telescopic tube. When occupying its active working position, the bevelled end surface of the locking arm is intended to engage beneath a correspondingly bevelled end surface on the outer tube 6 for locking co-action therewith, c.f. FIG. 1B.

The inner telescopic tube 7 is pivotally connected to the work surface 1 by means of a pivot in the form of a peg 10 which passes diametrically through the tube 7 and the sleeve-like end 9 of the locking arm 8, between two mutually opposing flanges 11 fitted to the work surface 1. The outer telescopic tube 6 is similarly pivotally mounted by means of a pivot in the form of a peg 12 which extends between two mutually opposing flanges 13 fitted to the frame 5, and passes diametrically through the tube 6.

A compression spring 14 is fitted in the inner tube 7 between a fixed plate 15 at the free end of the tube and a movable plate 16 which is displaceable in the direction of the longitudinal axis of the tube. The movable plate 16 is connected to one end of a pull rod 17, the other end of which is attached to the pivot or hinge pin 12 of the outer tube 6 through the intermediary of a pull ring. The length of the pull rod 17 is adapted so that the spring 14 is slightly compressed between the plates 15 and 16 even when the work surface is lowered, such as to exert a force which strives to hold the telescopic tubes 6 and 7 retracted, one within the other, and therewith dampen any oscillatory movement of the downwardly depending work surface 1.

The manner in which the inventive brace assembly works is best seen from FIG. 1B, which shows the work surface 1 raised to a level in which it is flush with the fixed or stationary surface 2. This upward swinging of the work surface has resulted in the inner tube 7 being withdrawn from the outer tube 6, and in the simultaneous displacement of the movable plate 16 in relation to the inner tube 7 through the action of the pull rod 17, which is secured to the outer tube 6 by the locking pin 12, while at the same time compressing the spring 14 between the movable plate 16 and the plate 15 firmly mounted at the end of the tube 7. With the brace assembly in this working mode, the compressed spring 14 will strive to restore the telescopic tubes to their relative starting positions shown in FIG. 1A. The return, or retraction, of the tubes, however, is prevented by the locking arm 8, which in the position shown in FIG. 1B is in locking engagement (full lines) with the outer telescopic tube 6. The locking arm is biased towards its locking position by means of a bias spring 18 (see FIG. 1A), which acts between the inner telescopic tube 7 and a tubular part of the locking arm.

Unintentional release of the locking arm 8 is also prevented through the engagement of the free, bevelled end of the locking arm with the undersurface of the correspondingly bevelled edge of the outer tube 6, this locking engagement being maintained in the illustrated position also through the weight of the work surface 1 acting on the arm. The forward end of the locking arm 8 is also bevelled so that its outer surface will coincide essentially with the bevelled or chamfered outer surface of the outer telescopic tube 6. This means that engagement of the bevelled end surface of the locking arm 8 with the end surface of the telescopic tube 6 takes place over a relatively large peripheral arcuate surface, thereby avoiding the drawbacks associated with punctiform contact between the mutually engaging surfaces and also the subsequent elevated wear thereon which would result from such contact.

In order to enable the locking arm 8 to swing freely to some slight extent, to the position shown in chain lines in FIG. 1B, the diameter of the sleeve-shaped part 9 of the arm must be greater than that of the telescopic tube 7, so as to provide sufficient space for such movement to take place.

When the described inventive brace assembly is brought to its active state, illustrated in FIG. 1B, the brace provides an extremely stable support for the work surface 1, and in relation to the brace or stay assembly described in our aforementioned U.S. patent application also affords, inter alia, the advantage that the extension of the telescopic tubes, one from the other, is stopped automatically subsequent to reaching a given extent of extension. This stop facility comes into affect when the spring 14 is fully compressed between the plates or like devices 15 and 16, therewith preventing further mutual displacement of the tubes in the direction of their longitudinal axes. This will prevent, for example, the work surface from being raised to an excessive extent, in a manner liable to damage the hinge means 3. It must be possible, however, to lift the work surface 1 slightly above its intended level with the frame surface, in order to enable the engagement of the end of the locking arm 8 with the telescopic tube 6 to be released by exerting a slight pressure on the tubular part 9 of the locking arm in the direction of arrow A. Subsequent to releasing this locking engagement of the arm 8, the arm will take the position shown in broken lines in FIG. 1B, therewith enabling the work surface 1 to be lowered.

Figure 2:
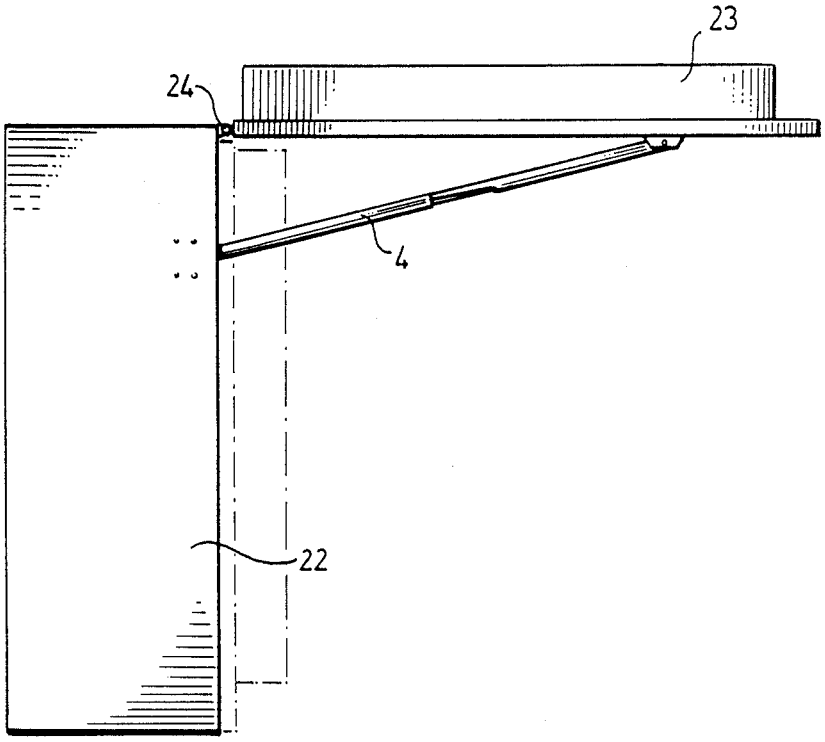
FIG. 2 illustrates the use of a brace assembly of FIG. 1 for supporting the closing flap of a cabinet.

FIG. 2 illustrates the use of a brace assembly 4 of FIG. 1 for supporting a closing flap 23 hinged to a cabinet 22 by means of a hinge 24. In this application it is very important that the flap cannot be excessively raised so that the telescopic tubes are separated from each other. The automatic stop facility of the brace 4 of FIG. 2 will prevent this.

A further advantage afforded by the described inventive brace assembly in relation to the aforementioned prior art brace or stay assemblies is that the auxiliary reinforcing tube in the outer telescopic tube 6 can be omitted from the inventive brace. When the brace assembly is extended and actively supports the work surface 1, as illustrated in FIG. 1B, the plates 15 and 16, together with the intermediate compressed spring 14, serve to stiffen the telescopic tube - and correspond essentially to an auxiliary reinforcing tube at this location of the brace. This will reduce the risk of the brace buckling under load, without requiring the presence of an additional reinforcing tube.

Figure 3:
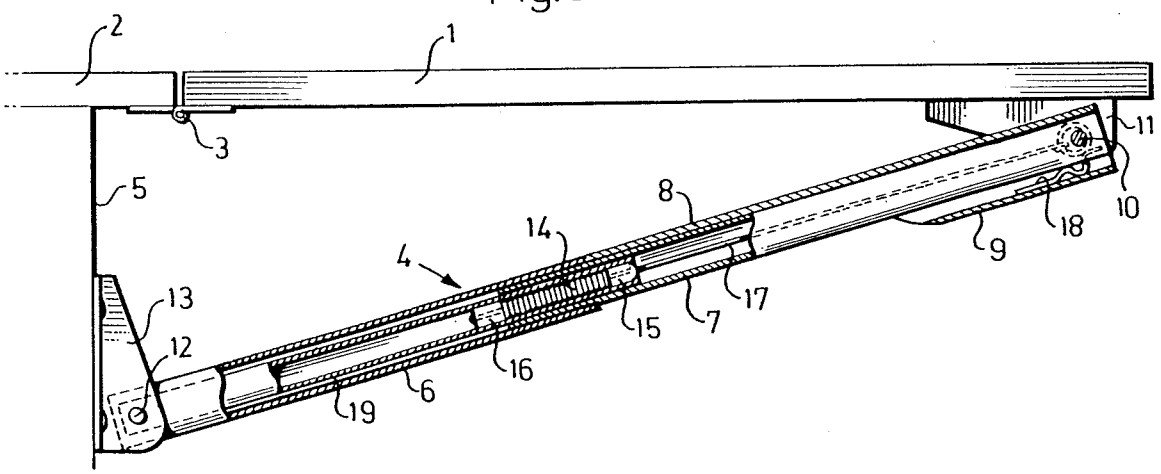
FIG. 3 illustrates an alternative embodiment of the inventive brace assembly with the brace shown in an active working position.

FIG. 3 illustrates an alternative embodiment of a brace assembly according to the invention, with the brace in an extended, active position. Corresponding components have been identified in FIG. 3 with the same reference numerals as those used in FIGS. 1A and 1B. The FIG. 3 embodiment differs from the FIG. 2 embodiment insomuch as the compression spring 14 is placed in the outer telescopic tube 6 instead of in the inner telescopic tube 7. In addition hereto, the FIG. 3 embodiment incorporates an auxiliary reinforcing tube 19 which is arranged in and fixed relative to the outer telescopic tube 6, such that the auxiliary tube will accompany the movement of the outer tube 6 while being guided in the inner tube 7. In the case of the FIG. 3 embodiment, the stationary or fixed plate 15 is mounted on one end of the auxiliary tube 19, whereas the movable plate 16 is arranged to be moved in the axial direction of the auxiliary tube 19 by means of the pull rod 17, which in this case is attached to the locking pin 10 extending through the inner telescopic tube 7. The brace assembly illustrated in FIG. 3 functions in the same manner as the brace assembly illustrated in FIG. 1B, although the FIG. 3 brace assembly will withstand a higher load due to the inclusion of the auxiliary reinforcing tube 19. The embodiment illustrated in FIG. 1B, however, has been found strong enough for the majority of applications.

The aforedescribed embodiments may also be modified in other respects within the scope of the invention. For example, the brace assembly may include a separate stop element, in the form of an abutment surface, for engagement with the plate 15 such as to stop withdrawal of the telescopic tubes, one from the other, before the spring 14 is fully compressed. Furthermore, the plates 15 and 16 or like devices may be given axial extensions such as to provide the desired stiffening of the tube 7. The plates may also be given a tubular configuration, so that while being compressed the spring 14 will be urged into the plates. The stop position can therewith be located at the position in which the plates 15 and 16 contact one another. The pull rod may, of course, also be replaced with a pull wire or like device.

When required by a particular application, the work surface 1 can be allowed to swing down further than the positions shown in FIGS. 1A and 1B, or may be stopped before reaching said positions.

It will be understood that the inventive brace assembly can be used to support other types of flaps or pivotable parts, irrespective of their orientation and pivotal directions. Because the two ends of the brace assembly can be mounted with the aid of through-passing locking pins, the brace can be fitted selectively to any desired object. The brace assembly can also be mounted between two pivotable objects. Although the illustrated telescopic tubes have a circular cross-section, it will be understood that the tubes may have a square cross-section or any other suitable cross-section.

Figure 4:
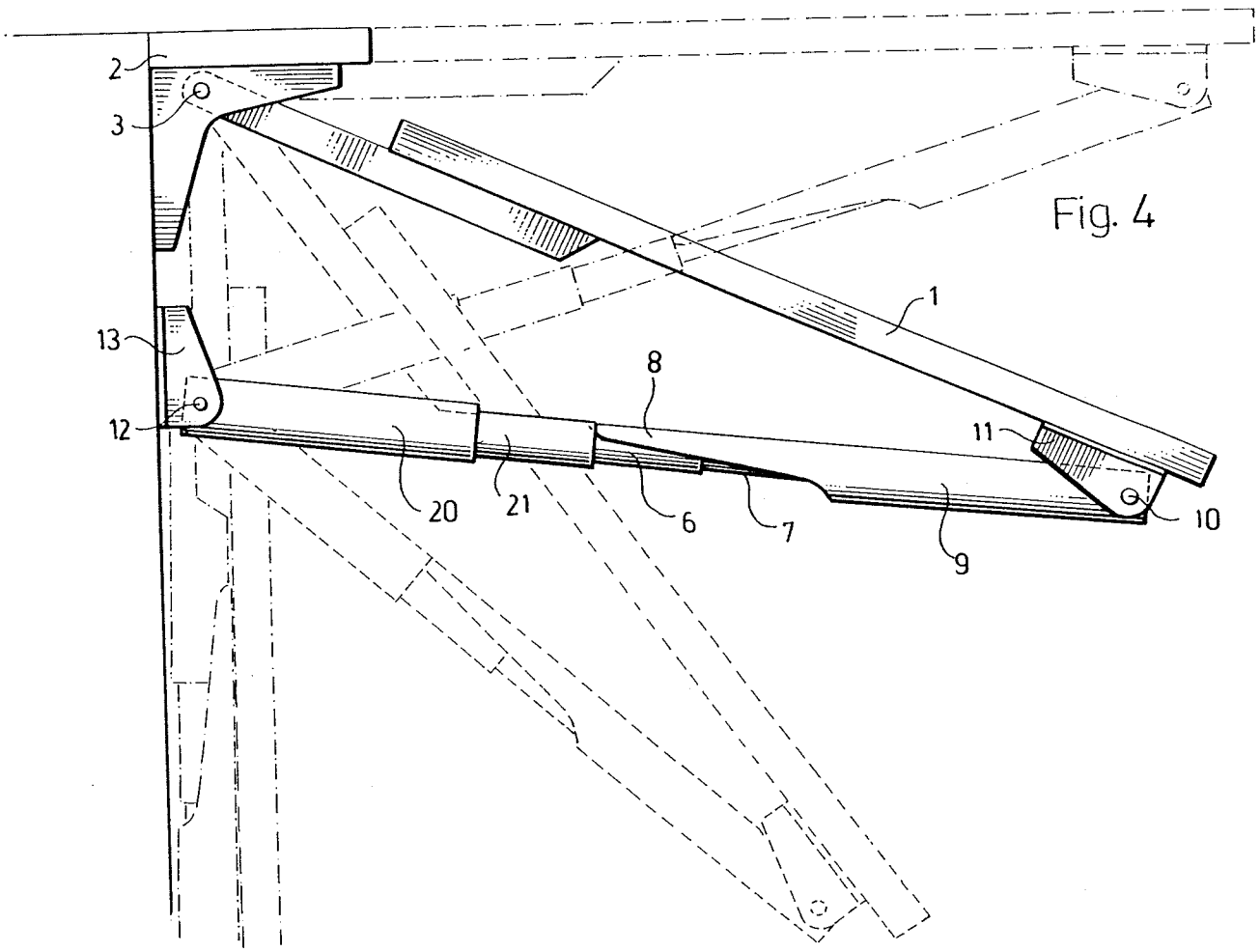
FIG. 4 illustrates a further variant of the inventive brace assembly.

For certain applications it may be desirable to lock together in different relative positions objects which can be swung relative to one another, for example such objects as the hinged tops of writing desks, drawing tables, ventilation flaps, etc. To this end the brace assembly may be modified in the manner illustrated in FIG. 4, in which corresponding components have been identified with the same reference numerals as those used in FIGS. 1–3. The only difference between the modified brace assembly and the aforedescribed brace assemblies is that the outer telescopic tube 6 of the FIG. 4 embodiment is surrounded by two additional, shorter tubes 20 and 21, respectively. The end surface of each tube 6, 20 and 21 forms one engagement shoulder for the locking arm 8. This enables the brace assembly of FIG. 4 to be used to lock the work surface 1 in any of three different positions relative to the other object 2, as illustrated schematically in the Figure. In order to change the position of the work surface between the aforesaid different positions, the same manipulations as those described above with reference to FIGS. 1–3 must be carried out.

Instead of using three different tubes 6, 20 and 21, several engagement shoulders may be provided on the outer surface of the tube 6 in a suitable manner.

We claim:

1. A telescopic brace assembly (4) for use with two objects (1, 2) which are capable of being folded relative to one another and particularly intended for supporting a work surface (1) which can be folded relative to a frame structure (5), said brace assembly including two tubes (6, 7) which are capable of being telescopically displaced one within the other and the mutually opposite free ends of which are intended to be pivotally connected (10, 12) to a respective one of said objects, a spring (14) arranged in the telescopic tubes for biasing the tubes together; and locking means (8) for releasably locking the telescopic tubes relative to one another in an active supporting position of the brace assembly, said spring comprising a compression spring disposed such that when the telescopic tubes are withdrawn one from the other the spring is compressed to attendantly store energy therein; the extent to which the telescopic tubes can be withdrawn one from the other being determined by a maximum degree of compression of the spring, wherein one end of the spring co-acts with a stop means (15) which is stationary in relation to one of said telescopic tubes; the spring is adapted to be compressed against said stop means with the aid of a pull rod (17) which accompanies movements of the other telescopic tube and which is connected (16) to the other end of the spring, wherein the spring is arranged in an inner one (7) of said two telescopic tubes and is compressible against said stop means located at a free end of said inner tube, said pull rod extending through the stop means, one end thereof being located in and firmly held (12) relative to an outer one of said telescopic tubes and another opposite end thereof being connected (16) to an end of the spring distal from the stop means.

2. A brace assembly according to claim 1, wherein said stop means has the form of a first plate (15) which is securely attached to an end of an associated one of the telescopic tubes; and said other end of the pull rod is connected to a second plate (16) which is arranged for movement in said tube and which co-acts with said other end of the spring.

3. A brace assembly according to claim 2, wherein the extent to which the telescopic tubes can be withdrawn from one another is determined by the length of the movement path of said second plate in its associated one of the telescopic tubes.

4. A brace assembly according to claim 2, wherein the plates have an axial extension such that the plates are effective to strengthen those parts of the telescopic tubes which surround the plates when the tubes are extended to their operative, supporting positions.

5. A telescopic brace assembly (4) for use with two objects (1, 2) which are capable of being folded relative to one another and particularly intended for supporting a work surface (1) which can be folded relative to a frame structure (5), said brace assembly including two tubes (6, 7) which are capable of being telescopically displaced one within the other and the mutually opposite free ends of which are intended to be pivotally connected (10, 12) to a respective one of said objects, a spring (14) arranged in the telescopic tubes for biasing the tubes together; and locking means (8) for releasably locking the telescopic tubes relative to one another in an active supporting position of the brace assembly, said spring comprising a compression spring disposed such that when the telescopic tubes are withdrawn one from the other the spring is compressed to attendantly store energy therein; the extent to which the telescopic tubes can be withdrawn one from the other being determined by a maximum degree of compression of the spring, wherein one end of the spring co-acts with a stop means (15) which is stationary in relation to one of said telescopic tubes; the spring is adapted to be compressed against stop means with the aid of a pull rod (17) which accompanies movements of the other telescopic tube and which is connected (16) to the other end of the spring, the spring is mounted in an auxiliary reinforcing tube (19) which is arranged in an outer one (6) of the telescopic tubes and fixed in relation thereto and which slides in an inner one (7) of the telescopic tubes, said stop means is located at the free end of the reinforcing tube, and said pull rod extends through the stop means, one end thereof being arranged in and fixed (10) relative to the inner telescopic tube and another, opposite end thereof being connected (16) to an end of the spring distal from the stop means.

6. A brace assembly according to claims 1 or 5, wherein said one end of the pull rod is firmly fixed to a locking pin which serves as a pivot pin, and which extends diametrically through the tube surrounding said one end of the pull rod.

7. A brace assembly according to claims 1 or 5, wherein the spring is dimensioned so that when the telescopic tubes are fully retracted, one within the other, the spring will exert a force on said tubes which strives to hold the tubes together.

* * * * *